US008873778B2

(12) United States Patent
Nakano

(10) Patent No.: US 8,873,778 B2
(45) Date of Patent: Oct. 28, 2014

(54) SOUND PROCESSING APPARATUS, SOUND IMAGE LOCALIZATION METHOD AND SOUND IMAGE LOCALIZATION PROGRAM

(75) Inventor: Kenji Nakano, Kanagawa (JP)

(73) Assignee: Sony Corporation (JP)

( * ) Notice: Subject to any disclaimer, the term of this patent is extended or adjusted under 35 U.S.C. 154(b) by 566 days.

(21) Appl. No.: 12/798,858

(22) Filed: Apr. 13, 2010

(65) Prior Publication Data

US 2010/0266133 A1 Oct. 21, 2010

(30) Foreign Application Priority Data

Apr. 21, 2009 (JP) ..... P2009-102701

(51) Int. Cl.
*H04R 5/02* (2006.01)
*H04R 3/04* (2006.01)
*H04S 7/00* (2006.01)

(52) U.S. Cl.
CPC ..... *H04R 3/04* (2013.01); *H04S 2420/01* (2013.01); *H04R 2205/024* (2013.01); *H04S 7/302* (2013.01); *H04R 2499/15* (2013.01); *H04R 2499/13* (2013.01)
USPC ..... 381/303; 381/302; 381/306

(58) Field of Classification Search
USPC ..... 381/302, 306, 86, 310
See application file for complete search history.

(56) References Cited

U.S. PATENT DOCUMENTS 5,850,453 A * 12/1998 Klayman et al. ..... 381/86
7,561,706 B2 * 7/2009 Holmi et al. ..... 381/306

FOREIGN PATENT DOCUMENTS

JP 05-043700 U 6/1993

OTHER PUBLICATIONS

Blauert, J. (1969/70) "Sound Localization in the Median Plane", Acustica 22, pp. 205-213.

* cited by examiner

*Primary Examiner* — Ping Lee
(74) *Attorney, Agent, or Firm* — Lerner, David, Littenberg, Krumholz & Mentlik, LLP

(57) ABSTRACT

A sound processing apparatus includes: a filter means for providing a sound signal with a frequency-gain characteristic according to a spectrum difference between a previously measured first head-related transfer function of a sound generated from a virtual sound image position to an ear of a listener and a previously measured second head-related transfer function of a sound generated from a real sound source position to the ear, and outputting the sound signal.

7 Claims, 5 Drawing Sheets

12 CONFIGURATIONAL EXAMPLE 1 OF SOUND IMAGE LOCALIZATION FILTER

12 CONFIGURATIONAL EXAMPLE 2 OF SOUND IMAGE LOCALIZATION FILTER

12 CONFIGURATIONAL EXAMPLE 3 OF SOUND IMAGE LOCALIZATION FILTER

ENLARGED VIEW OF PORTION B IN FIG. 6

SOUND PROCESSING APPARATUS, SOUND IMAGE LOCALIZATION METHOD AND SOUND IMAGE LOCALIZATION PROGRAM

CROSS-REFERENCE TO RELATED APPLICATION

The present application claims priority from Japanese Patent application Ser. No. JP 2009-102701 filed in the Japanese Patent Office on Apr. 21, 2009, the entire content of which is incorporated herein by reference.

BACKGROUND OF THE INVENTION

1. Field of the Invention

The present invention relates to a sound processing apparatus, a sound image localization method, and a sound image localization program, which are adapted to an apparatus for reproducing sound signals, such as a television receiver or an on-vehicle audio apparatus, and move a sound image originated from a sound to be reproduced.

2. Description of the Related Art

Recent television receivers and on-vehicle audio apparatuses are mostly designed to have a speaker located below the head of a listener. When reproduced sounds are generated from a speaker located below the head of a listener, therefore, a sound image is expanded below the head of the listener, giving unnatural sound field feeling.

To improve such a situation, therefore, it is desirable to provide a function of raising the localization position of a sound image to give natural sound field feeling. In the past, a process of emphasizing a frequency band component (around 8 kHz) at which a listener feels the direction of a sound source above the head in terms of the auditory sensation is carried out as disclosed in, for example, JP-UM-A-5-43700 (Patent Literature 1).

A frequency band where a specific directivity is sensed depending on the center frequency of stimulation regardless of the direction of a sound source is defined as a directional band by Blauert. The definition is mentioned in, for example, Blauert, J. (1969/70) "Sound localization in the median plane" Acustica 22, 205-213 (Non-patent Literature 1).

SUMMARY OF THE INVENTION

However, the aforementioned directional band in the direction toward above a head is a narrow band around about 8 kHz, and a process of actually emphasizing this band alone provides an unstable effect on sounds having various frequency spectra.

Therefore, there is a need for providing sound image localization effects, such as a sound image enhancing effect, over as a wide band as possible.

Thus, it is desirable to stably provide an upward or downward sound image localization effect over a wide frequency band without performing a complicated process.

According to an embodiment of the present invention, there is provided a sound processing apparatus including a filter means for providing a sound signal with a frequency-gain characteristic according to a spectrum difference between a previously measured first head-related transfer function of a sound generated from a virtual sound image position to an ear of a listener and a previously measured second head-related transfer function of a sound generated from a real sound source position to the ear, and outputting the sound signal.

According to the sound processing apparatus of the embodiment of the invention, the filter means provides a sound signal with a frequency-gain characteristic according to a spectrum difference between a previously measured first head-related transfer function of a sound generated from a virtual sound image position to an ear of a listener and a previously measured second head-related transfer function of a sound generated from a real sound source position to the ear, and outputs the sound signal.

Accordingly, with regard to a sound signal to be output, an influence according to the previously measured second head-related transfer function of a sound generated from the real sound source position to an ear of a listener is reduced, so that the characteristic according to the second head-related transfer function can be made flat. In addition, an influence according to the previously measured first head-related transfer function of a sound generated from the virtual sound image position to the ear of the listener can be added. This can allow the localization position of the sound image of a reproduced sound to be shifted toward the virtual sound image position.

According to the embodiment of the invention, it is possible to stably provide an upward or downward sound image localization effect over a wide frequency band without performing a complicated process.

DETAILED DESCRIPTION OF THE PREFERRED EMBODIMENT

An embodiment of a sound processing apparatus, a sound image localization method, and a sound image localization program according to embodiments of the present invention will be described below with reference to the accompanying drawings. The following description of the embodiment will be given of a case where a real sound source is located below the head of a listener, and a sound image originated from a sound generated from the real sound source is localized above the real sound source, by way of example.

[Examination on Directional Band Other Than 8 kHz Band]

The directional band in the direction toward above the head, which has been used in the past, is only a narrow band around about 8 kHz. An examination has therefore been made on the spectrum cue for upper (or lower) sound image localization other than the band.

Figure 1:
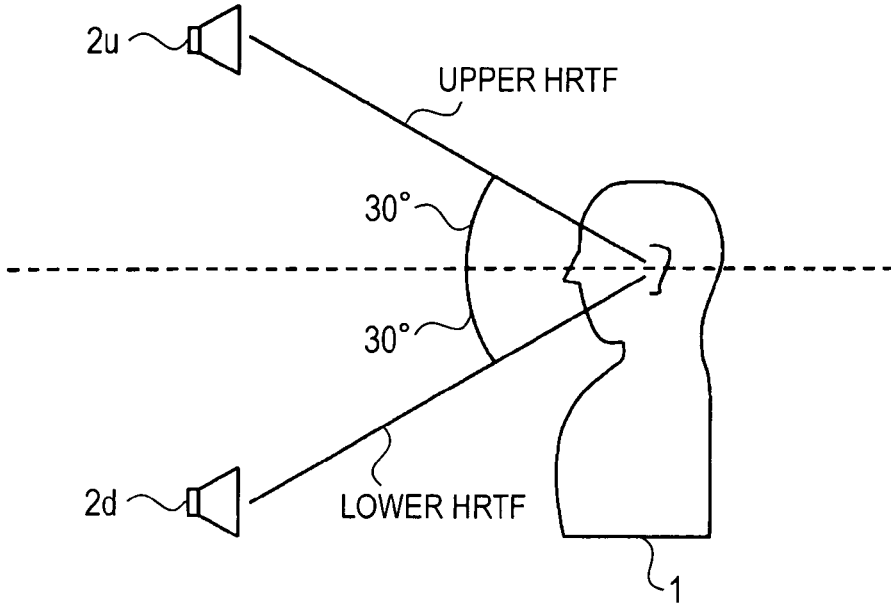
FIG. 1 is a diagram for explaining an environment of measuring head-related transfer functions.
Figure 2:
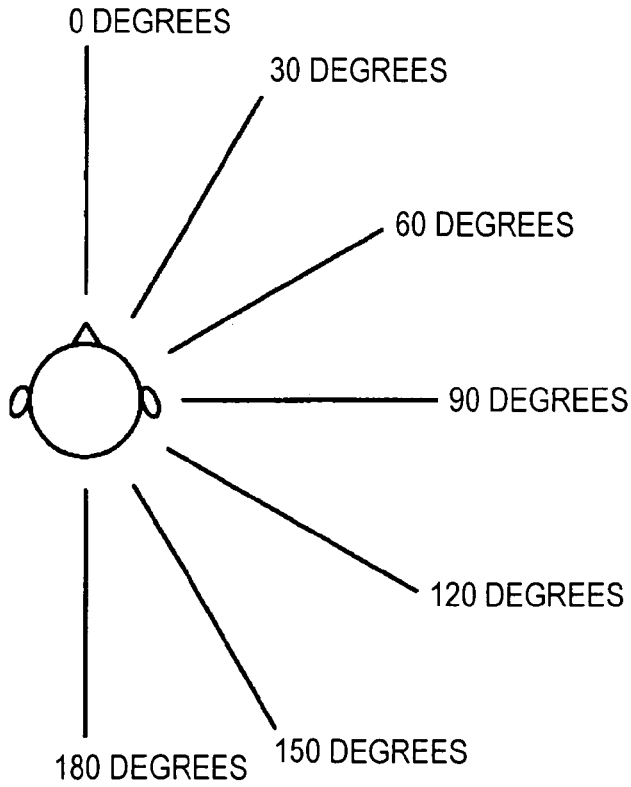
FIG. 2 is a diagram for explaining the environment of measuring head-related transfer functions.
Figure 3A:
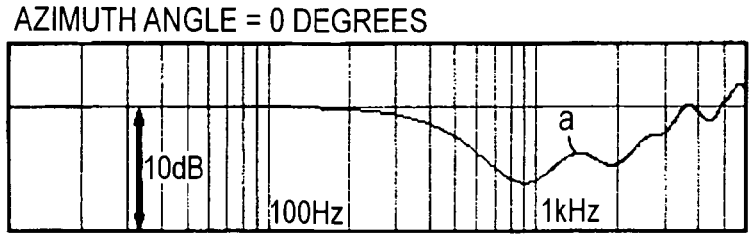
FIGS. 3A to 3G are diagrams showing characteristics of differences between an upper head-related transfer function and a lower head-related transfer function, which are measured while changing an azimuth angle.
Figure 3B:
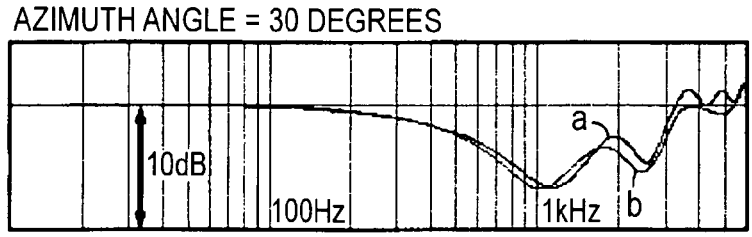
Figure 3C:
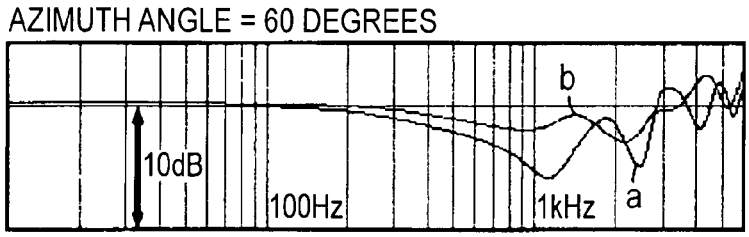
Figure 3D:
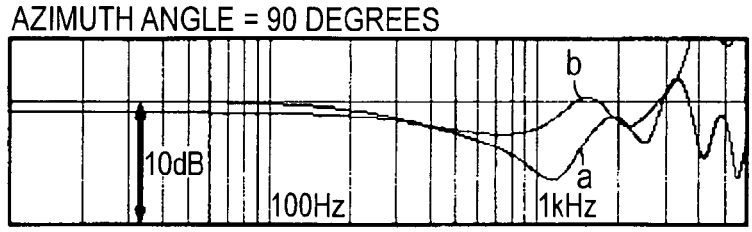
Figure 3E:
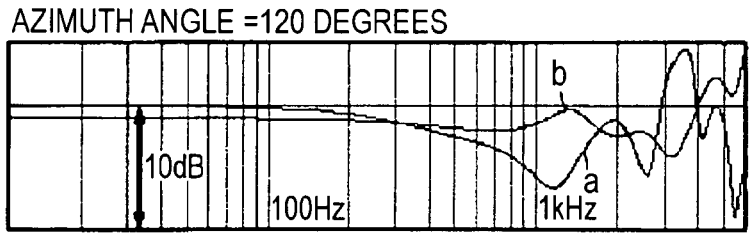
Figure 3F:
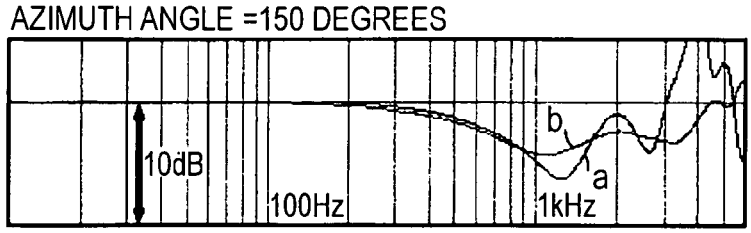
Figure 3G:
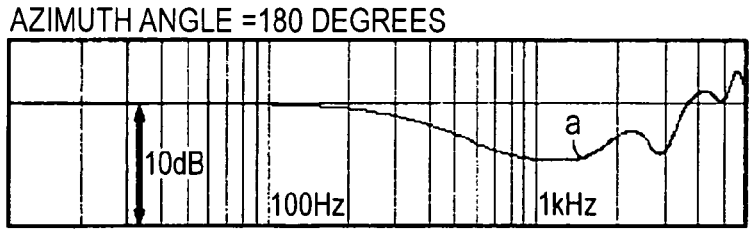

FIGS. 1 and 2 are diagrams for explaining examination conditions for the examination. In FIG. 1, as indicated by a broken line, with a horizontal plane passing ears of a listener 1 being a boundary, an up sound source 2*u* is provided in a direction of a climbing angle (elevation angle on a median plane) of about 30 degrees from the horizontal plane, and a down sound source 2*d* is provided in a direction of a declining angle (depression angle on the median plane) of about 30 degrees from the horizontal plane.

Those up sound source 2*u* and down sound source 2*d* are moved around the listener 1 from the position (median plane) of 0 degrees with respect to the listener 1 to positions indicated by azimuth angle pitches of 30 degrees, as shown in FIG. 2. With the up sound source 2*u* and down sound source 2*d* located at the individual azimuth angle positions, head-related transfer functions are measured.

Specifically, as shown in FIG. 1, an upper head-related transfer function (hereinafter referred to as "upper HRTF") and a lower head-related transfer function (hereinafter referred to as "lower HRTF") are measured at the positions indicated by azimuth angle pitches of 30 degrees shown in FIG. 2 without changing the direction of the head of the listener.

The measurement of the head-related transfer functions is carried out by using the HATS (Head And Torso Simulator) produced by B & K with the average size of races all over the world based on the HUMANSCALE 1/2/3.

The spectrum difference "upper HRTF−lower HRTF" between the upper HRTF and the lower HRTF measured for each azimuth angle is obtained and plotted on a graph.

FIGS. 3A to 3G are diagrams showing the frequency spectra when spectrum differences "upper HRTF−lower HRTF" between the upper HRTFs and the lower HRTFs with the horizontal plane as a boundary are obtained according to the aforementioned examination conditions.

FIGS. 3A to 3G show spectrum differences "upper HRTF−lower HRTF" between the upper HRTFs and the lower HRTFs are measured for the individual azimuth angle pitches (0 degrees, 30 degrees, 60 degrees, 90 degrees, 120 degrees, 150 degrees and 180 degrees) of 30 degrees with the front side (0 degrees) of the listener 1 being a reference. In FIGS. 3A to 3G, the abscissa represents the frequency (logarithm memory), and the ordinate represents the gain (dB).

In FIGS. 3A to 3G, the frequency spectrum indicated by reference numeral "a" is the HRTF spectrum difference "upper HRTF−lower HRTF" at the ear on the sound source side (right ear in the example in FIG. 2). The frequency spectrum indicated by reference numeral "b" is the HRTF spectrum difference at the ear on the opposite side to the sound source (left ear in the example in FIG. 2).

The comparison of FIGS. 3A to 3G with one another shows a characterizing common structure of having a spectrum difference concaved as compared with the low frequency side in a band from about 200 Hz to about 1.2 kHz regardless of the azimuth angle.

That is, it is apparent that the level of the same band of the upper HRTF of the same azimuth angle tends to become lower as compared with the lower HRTF. The tendency is fulfilled regardless of the azimuth angle.

Let us consider a case where a sound source (lower speaker) is provided below the head of the listener to generate a sound, and a filter which localizes a sound image formed by a sound generated from the sound source based on the head-related transfer functions (HRTFs).

To simplify the description, the following description will be given of a case where the down sound source 2*d* and the up sound source 2*u* are provided in the direction of a median plane (0 degrees shown in FIG. 2) in which the head-related transfer functions (HRTFs) at both ears become substantially equal to each other, by way of example.

Figure 4:
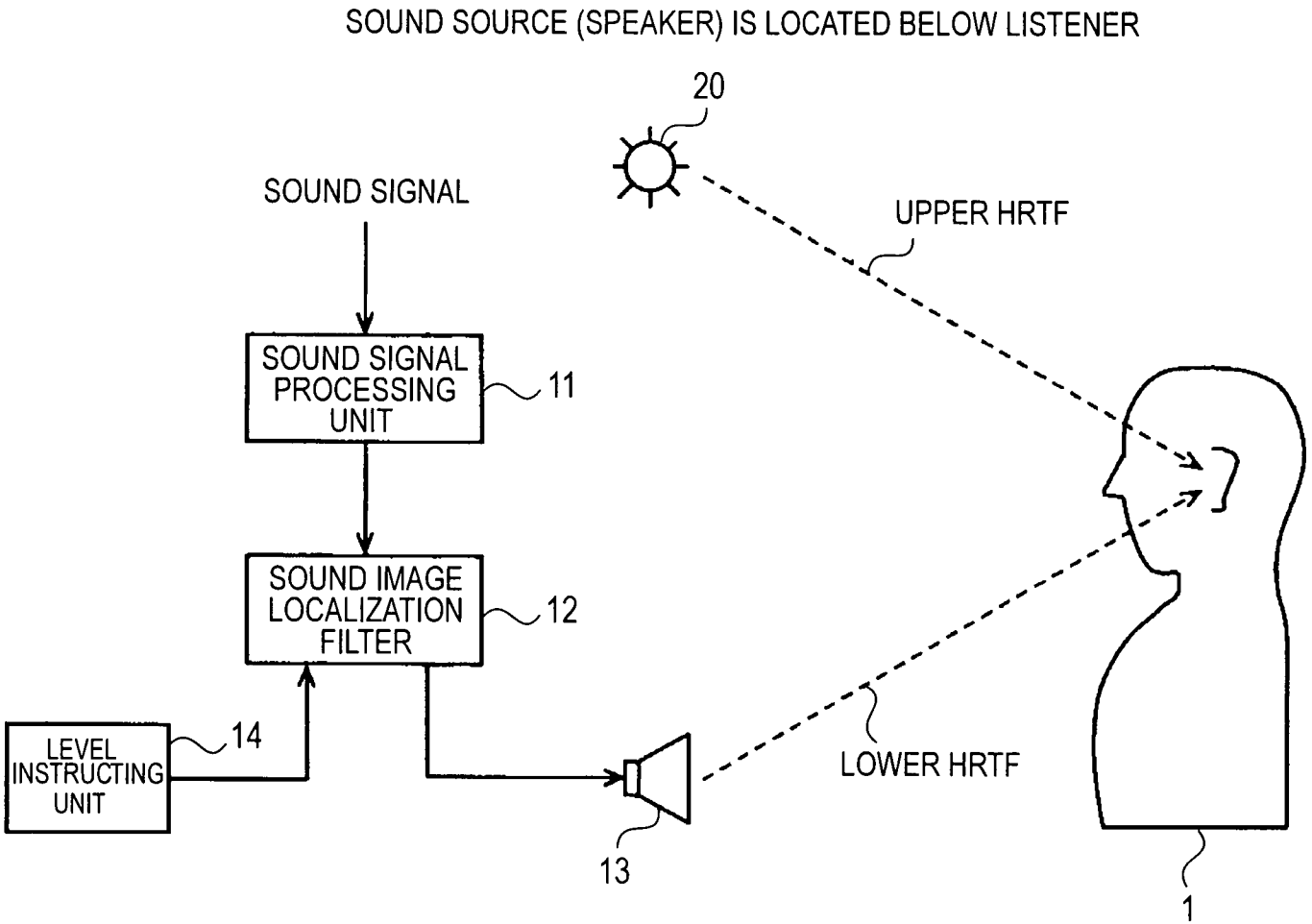
FIG. 4 is a diagram for explaining an sound processing apparatus to which an embodiment of the invention is adapted.

FIG. 4 is a diagram for explaining the sound processing apparatus according to the embodiment of the invention, and also explaining the relation among the listener, the sound source and the sound image. As shown in FIG. 4, the sound processing apparatus according to the embodiment includes a sound signal processing unit 11, a sound image localization filter 12, a speaker 13, and a level instructing unit 14.

The sound processing apparatus according to the embodiment can be adapted to various audio apparatuses which process and output audio signals (sound signals) from, for example, a television receiver, an on-vehicle audio apparatus, and a game device.

As shown in FIG. 4, the sound processing apparatus according to the embodiment is designed in such a way that when the speaker (sound source) 13 is located below the listener 1, a sound image originated from a reproduced sound generated from the speaker 13 can be sensed at a virtual sound image position 20 or at a position near that position 20.

That is, in FIG. 4, the position of the speaker (sound source) 13 is a real sound source position at which a sound is actually generated, and the position indicated by the sound image 20 is a virtual sound image position (virtual sound source) at which the user senses the sound image.

The sound signal processing unit 11 is supplied with, for example, digital sound signals read from various recording media, or digital sound signals separated from digital broadcast signals received.

The sound signal processing unit 11 forms a digital sound signal of a predetermined format to be reproduced from a digital sound signal supplied thereto, and supplies the formed digital sound signal to the sound image localization filter 12.

When the supplied digital sound signal is of a data compressed type, for example, the sound signal processing unit 11 performs an expanding process to restore the digital sound signal to a digital sound signal before data compression. When the supplied digital sound signal is a signal modulated in a predetermined modulation system, the sound signal processing unit 11 performs a process of demodulating the digital sound signal to original digital sound data.

As shown in FIG. 4, the sound image localization filter 12 provides the reproduced sound with a frequency-gain characteristic according to the spectrum difference between the head-related transfer function from the previously measured virtual sound image position 20 to the ear of the listener 1 (upper HRTF) and the head-related transfer function from the speaker 13 to the ear of the listener 1 (lower HRTF). The spectrum difference is given by "upper HRTF−lower HRTF".

Giving the characteristic according to "upper HRTF−lower HRTF" to a reproduced sound means that the following two processes (1) and (2) are performed on the sound generated from the speaker 13. That is, it means that (1) the characteristic of the sound generated from the speaker 13 and reaching the ear of the listener 1 is corrected to be flat with the characteristic from the speaker 13 to the ear of the listener 1 (lower HRTF), and (2) in addition, the characteristic from the sound image (virtual sound image position) 20 at the target position to the ear of the listener 1 (upper HRTF) is added to the sound generated from the speaker 13 and reaching the ear of the listener 1.

Then, the digital sound signal provided with the characteristic "upper HRTF−lower HRTF" is converted to an analog sound signal, which is then supplied to the speaker 13 so that the reproduced sound is generated therefrom.

In the sound processing apparatus according to the embodiment, the characteristic "upper HRTF−lower HRTF" is added to a sound generated from the speaker 13 by the sound image localization filter 12. Accordingly, a reproduced sound can be listened in such a way that a sound image originated from a sound generated from the speaker 13 localized at the virtual sound image position 20 or a position close thereto.

In case of the example shown in FIG. 4, the speaker 13 and the virtual sound image position 20 lie on the median plane with respect to the listener 1. However, the case is not restrictive. When the speaker 13 and the virtual sound image position 20 do not lie on the median plane with respect to the listener 1, the basic approach is the same such that a sound signal to be reproduced is corrected with the lower HRTF and is provided with the upper HRTF characteristic.

At this time, if a relation given by the following equation 1 is fulfilled, the sound image of a reproduced sound can be shifted upward by the sound image localization filter 12 described above referring to FIG. 4 even when the speaker 13 and the virtual sound image position 20 do not lie on the median plane.

$$\text{upper } HRTF \text{ (left ear)} - \text{lower } HRTF \text{ (left ear)} = \text{upper } HRTF \text{ (right ear)} - \text{lower } HRTF \text{ (right ear)} \quad (1)$$

for HRTFs at both ears

Let us check on the characteristic of the difference between the upper HRTF and the lower HRTF again. FIGS. 3B to 3F show the characteristics of the difference when the speaker 13 and the virtual sound image position 20 do not lie on the median plane. Those characteristics show the tendency that the equation 1 becomes less fulfilled on the higher frequency side.

However, although the characteristics are not perfectly fulfilled by the equation 1, the difference is small in the low frequency band to the middle frequency band of up to about 1.2 kHz, and their curves are similar, the characteristics can be said to be approximated by the equation 1 from the macro viewpoint.

In conclusion, the characteristic "upper HRTF−lower HRTF" has the following features.

(A) In the band from about 200 Hz to about 1.2 kHz, the spectrum difference is concaved as compared with the low frequency side, regardless of the azimuth angle.

(B) In the low frequency band to the middle frequency band of up to about 1.2 kHz, the equation 1 is fulfilled from the macro viewpoint, regardless of the azimuth angle.

The following can be said from the features A and B. If the filter has a gain concaved as compared with the low frequency side in the band from about 200 Hz to about 1.2 kHz, a sound image can be shifted upward with a fixed filter structure in a band equal to or lower than about 1.2 kHz regardless of the azimuth angle. Because it is possible to cope with a wider band and various sounds as compared with the narrow directional band of near 8 kHz, the sound image enhancing effect becomes stable.

According to the embodiment, as explained above referring to FIG. 4, a sound image originated from the sound generated from the speaker 13 located below the listener 1 can be made sensible at the virtual sound image position 20 or a position near the position 20.

Let us consider a case where the sound image localization filter 12 described referring to FIG. 4 is a gain filter having positive and negative characteristics of opposite shapes. In this case, a sound image originated from the sound generated from the speaker located above the listener 1 (e.g., virtual sound image position 20) can be made sensible in the direction below the listener 1 (e.g., the position of the speaker 13) or a virtual sound image position positioned near the speaker position.

The tendency of being stable with respect to the azimuth angle means that a sound image of a sound generated from the speaker located below (above) the horizontal plane passing the position of the ears of a listener is localized above (below) in the positional relation between the speaker and the listener by a fixed filter structure regardless of the azimuth angle.

That is, the tendency indicates the possibility of a shift filter of a wider service area, which shifts the sound image position up or down, so that even the fixed filter can achieve a robust sound image moving effect at various listener positions.

Therefore, in case of shifting a sound image upward, as described above, the sound image localization filter (sound-image shifting up/down filter) has only to be a so-called parametric equalizer (PEQ) to make a sound signal of the band of 200 Hz to 1.2 kHz concaved. In case of shifting a sound image downward, on the other hand, the gain in the same band should be increased.

Figure 5A:
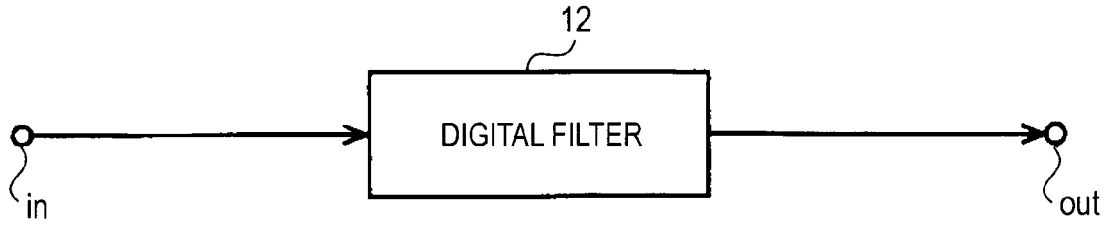
FIGS. 5A to 5C are diagrams for explaining configurational examples of a sound image localization filter.
Figure 5B:
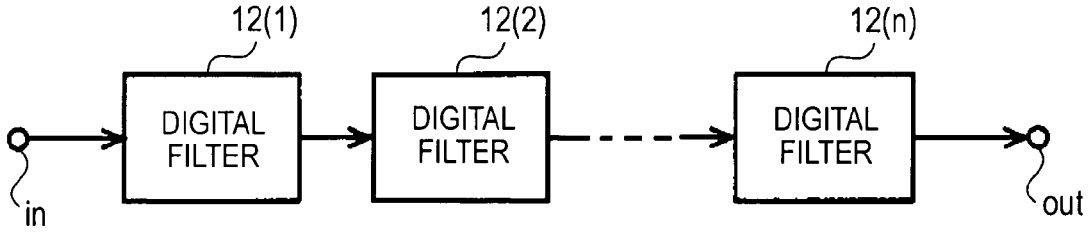
Figure 5C:
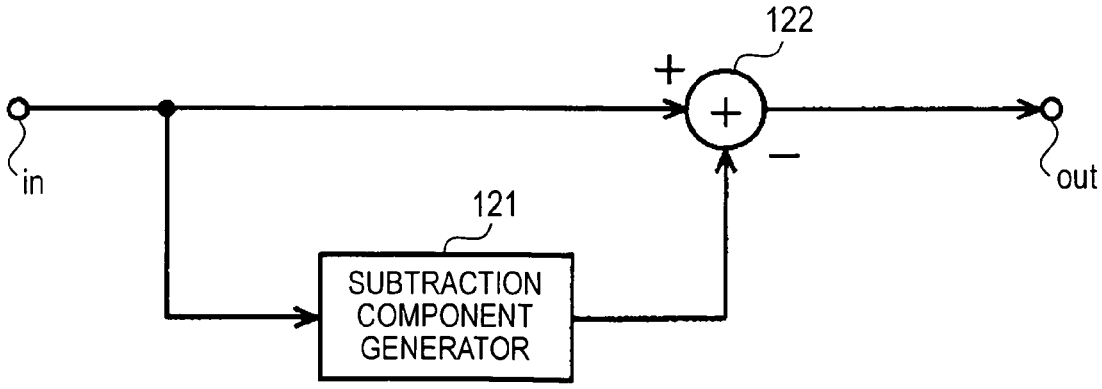

FIGS. 5A to 5C are diagrams for explaining configurational examples of the sound image localization filter 12. The sound image localization filter 12 can be realized by, for example, a single digital filter as shown in FIG. 5A. This digital filter 12 can be realized by the aforementioned PEQ, such as an IIR (Infinite Impulse Response) filter or FIR (Finite Impulse Response) filter.

The sound image localization filter 12 may be configured as multiple digital filters 12(1), 12(2), . . . 12(*n*) as shown in FIG. 5B. In this case, a desired gain can be provided by designating the frequency range delicately.

In addition, as shown in FIG. 5C, the sound image localization filter 12 may be configured to have a subtraction component generator 121 and a computing unit 122 (parallel structure).

In this case, the subtraction component generator 121 generates a signal (subtraction component signal) for providing a sound signal of the middle frequency band of 200 Hz to 1.2 kHz with a characteristic corresponding to the "upper HRTF−lower HRTF" based on the analog sound signal input to the subtraction component generator 121. The signal generated in the subtraction component generator 121 is supplied to the computing unit 122.

The computing unit 122 subtracts the signal (subtraction component signal), supplied from the subtraction component generator 121, from the band component of 200 Hz to 1.2 kHz of the supplied sound signal. This makes it possible to reduce the gain of the signal of the band of 200 Hz to 1.2 kHz and localize the sound image originated from the sound generated from the speaker located below the listener in the frontward direction of the listener or thereabove, as shown in FIGS. 3A to 3G.

Although the foregoing description of the embodiment has been given of the case where a digital sound signal is processed by way of example, the invention can be adapted to a case of processing an analog sound signal as well.

As apparent from the above, the sound image localization filter 12 can be realized in the form of equalizers with various structures.

[Level Adjustment According to Level Instruction]

As shown in FIG. 4, the level instructing unit 14 is provided to accept a level instruction input from the user and supply the level instruction input to the sound image localization filter 12. Then, the sound image localization filter 12 can adjust the gain of the band of 200 Hz to 1.2 kHz according to the instruction from the user.

In this case, the sound image localization filter 12 may be configured as a parametric equalizer to adjust the gain delicately, for example, in the unit of 10 Hz, in the unit of 100 Hz or the like, thus ensuring delicate gain adjustment according to the user's intention.

In addition, for example, the gain may be adjusted with respect to the center frequency, so that the gain in the range of 200 Hz to 1.2 kHz can be adjusted automatically according to the gain at the center frequency.

With the capability of adjusting the gain of a sound signal in the range of 200 Hz to 1.2 kHz which is related to the movement of a sound image, when the position of the virtual sound image position 20 shifts too high or too low, the user can adjust the position promptly and adequately.

[Compatibility with Multiple Channels]

To simplify the description, the following description will be given of a case where a sound is generated from a single speaker. However, television receivers and on-vehicle audio apparatuses often reproduce at least stereo sounds.

In case where, for example, stereo sounds are reproduced by stereo speakers located below the horizontal plane which passes through the ear portion of a listener with respect to the listener, the filtering process of the sound image localization filter, which has been explained above referring to FIG. 4 and FIGS. 5A to 5C, is performed on signals of each of the right and left channels.

A listening test in stereo sounds by using the sound image localization filter explained above referring to FIG. 4 and FIGS. 5A to 5C was conducted on a sound processing apparatus configured in the foregoing manner to reproduce stereo sounds. The test results show that many unspecified test subjects have recognized the sound image moving effect.

Dr. K. Genuit mentioned geometric influences of the individual parts (individual portions) of a human body on the sound image localization head-related transfer function HRTF). According to his statement, the head part influences the HRTF at a frequency of 400 Hz or higher, the shoulder part influences the HRTF at a frequency of 200 Hz to 10 kHz, and the body part influences the HRTF at a frequency of 100 Hz to 2 kHz.

As mentioned above, it is the difference between the upper HRTF and the lower HRTF, not the HRTF itself, that is used in the sound processing apparatus according to the embodiment, but the difference is not a little influenced by the parts of a human body.

Specifically, the upper HRTF seems to be influenced by the head part in the parts of a human body, and the lower HRTF seems to be influenced by the shoulder part and the body part as well as the head part.

Of course, the individual parts (portions) of a human body differs from one individual to another. However, the position and the size ratio of each part of a human body to the body, and the shape of each part do not significantly differ from one individual to another.

Even if the head-related transfer function (HRTF) is influenced by the individual parts of a human body, therefore, the filtering process is performed on a sound signal to be reproduced based on difference between the upper HRTF and the lower HRTF to which the influences are reflected. This makes it possible to shift (localize) a sound image originated from the sound generated from the speaker in front of the head part of each of multiple different listeners, or above or below the head part.

This is apparent from the aforementioned results of the listening test in stereo sounds using the sound image localization filter described referring to FIG. 4 and FIGS. 5A to 5C such that many unspecified test subjects have recognized the sound image moving effect.

As mentioned above, the problem of the upward directional band used in the past is such that the frequency band to be emphasized is a high frequency band (near 8 kHz) and is narrow, so that a matter of stability needs to be considered even when sound signals containing various frequency bands are to be processed.

Because the spectrum cue used in the sound processing apparatus according to the embodiment covers the major sound band of 200 Hz to 1.2 kHz, it has a merit of being capable of more stably providing various sounds with a clearer effect.

[Use of Conventional Directional Band]

As mentioned above, because the upward directional band used in the past is a high and narrow frequency band, there is a problem of stability. However, a certain effect can be expected from the upward directional band when sound signals containing a high frequency component of near 8 kHz is processed.

In this respect, as mentioned above, the sound processing apparatus according to the embodiment emphasizes the gain of a sound signal by decreasing the gain of the sound signal in the range of 200 Hz to 1.2 kHz and increasing the gain of the sound signal in the neighborhood of 8 kHz.

That is, the sound processing apparatus according to the embodiment to be described below processes sound signals by combination of the spectrum cue to be used newly and the upward directional band used in the past. This makes it possible to localize a sound image originated from the sound generated from the speaker 13 located below the listener 1 in the frontward direction of the listener 1 or above or below the direction, as shown in FIG. 4.

Figure 6:
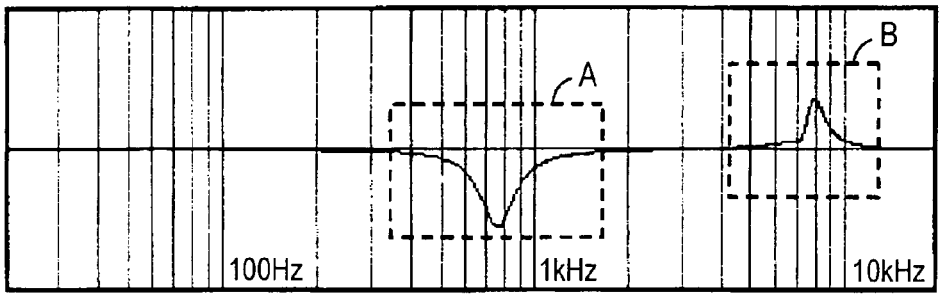
FIG. 6 is a diagram for explaining a case where a characteristic according to the difference between an upper head-related transfer function and a lower head-related transfer function is added, and emphasis on near 8 kHz is carried out.

FIG. 6 is a diagram showing the gain characteristic for explaining the process in case where the gain of a sound signal is emphasized by decreasing the gain of the sound signal in the range of 200 Hz to 1.2 kHz and increasing the gain of the sound signal in the neighborhood of 8 kHz.

In this example, the gain of a sound signal of a band of 200 Hz to 1.2 kHz is adjusted to become lower with 750 Hz, for example, being the center frequency as in a portion indicated by reference numeral "A" in FIG. 6. That is, this portion is what is adjusted to reduce the gain based on the aforementioned "upper HRTF−lower HRTF".

Further, the gain of a sound signal in the neighborhood of 8 kHz is adjusted to become higher with 8 kHz, for example, being the center frequency as in a portion indicated by reference numeral "B" in FIG. 6. This portion corresponds to the upward directional band used in the past.

As apparent from the above, signal processing in a wider band is achieved by targeting a sound signal in the range of 200 Hz to 1.2 kHz and a sound signal in the neighborhood of 8 kHz. This brings about merits of providing a more stable effect on various sounds and a making the effect of the upward shift of a sound image position clearer.

To emphasize the upward directional band in the neighborhood of 8 kHz, the neighborhood of 8 kHz is emphasized simply by an equalizer in the past. However, this system normally emphasizes the base portion of the band to be emphasized too, raising a problem that the degree of emphasis on the target band is made slightly weaker by frequency masking.

To cope with the problem, the front and rear end band of the upward directional band used may be suppressed. Although this system reduces the frequency masking, it still has a problem that the degree of emphasis is on the target band is small. In this respect, the sound processing apparatus according to the embodiment emphasizes the upward directional band rapidly from the low frequency side.

Figure 7:
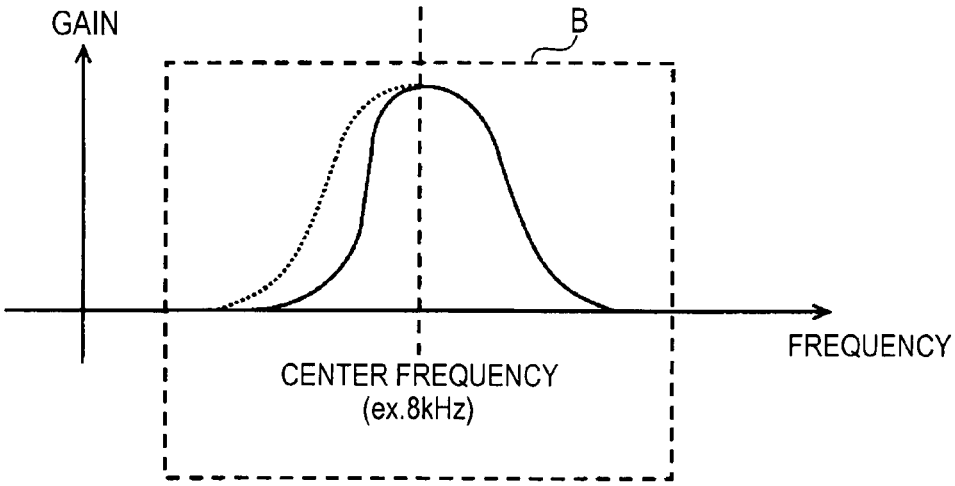
FIG. 7 is a diagram showing in enlargement the neighborhood of 8 kHz shown in FIG. 6.

FIG. 7 is a diagram showing in enlargement the neighborhood of 8 kHz indicated by the reference numeral "B" in FIG. 6. To make the gain symmetrical horizontally with 8 kHz being the center frequency, the low frequency side becomes as indicated by the broken dotted line as shown in FIG. 7.

As indicated by the solid line in FIG. 7, however, the gain is controlled in such a way to be increased rapidly from the low frequency side toward 8 kHz and adjusted to be horizontally symmetrical about 8 kHz.

This emphasizes the directional band, and suppresses the frequency masking on the low frequency side where the influence is said to be large, thereby providing the emphasis effect with a greater sensory level.

Figure 8:
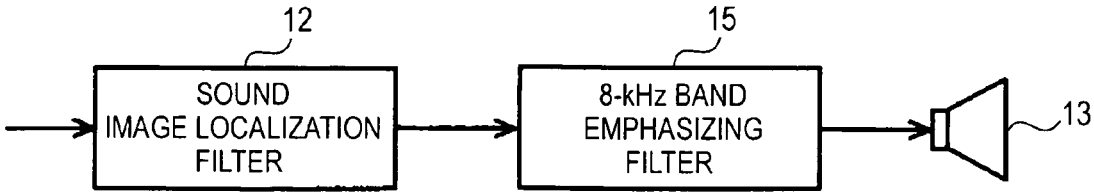
FIG. 8 is a diagram for explaining a sound processing apparatus which has a sound image localization filter and an emphasizing filter for emphasizing the neighborhood of 8 kHz.

FIG. 8 is a block diagram for explaining a sound processing apparatus which performs a process of emphasizing the gain of a sound signal by decreasing the gain in the range of 200 Hz to 1.2 kHz and increasing the gain of a sound signal in the neighborhood of 8 kHz, as described above referring to FIGS. 6 and 7.

As shown in FIG. 8, an 8-kHz band emphasizing filter 15 is provided between the sound image localization filter 12 and the speaker 13 in this example.

In FIG. 8, the sound image localization filter 12 is the same as the sound image localization filter 12 described above referring to FIG. 4 and FIGS. 5A to 5C. The sound image localization filter 12 performs a process of decreasing the gain of a sound signal in the range of 200 Hz to 1.2 kHz as in the portion indicated by reference numeral "A" in FIG. 6.

The 8-kHz band emphasizing filter 15 performs a process of increasing the gain of a sound signal in the portion indicated by reference numeral "B" in FIG. 6 or a sound signal in the neighborhood of 8 kHz as shown in FIG. 7. This 8-kHz band emphasizing filter 15 is also feasible in the form of a digital filter or a DSP (Digital Signal Processor).

Unlike in the example shown in FIG. 5C, the 8-kHz band emphasizing filter 15 may be configured by an addition component generator and an adder.

The sound image localization filter 12 and the 8-kHz band emphasizing filter 15 can adjust the gain of a sound signal to be reproduced to effect upward localization of a sound image originated from a sound generated from the speaker located below the listener.

[Fine Adjustment of Frequency Band and Adjustment of Gain Characteristic]

The foregoing description of the embodiment has been given of the case where the sound image localization filter 12 performs gain adjustment on a sound signal with 750 Hz being the center frequency as in the portion indicated by reference numeral "A" in FIG. 6. However, this case is not restrictive.

For example, the center frequency can be set to 800 Hz, 1 kHz or the like. Further, various modes are possible including, for example, the mode where with the center frequency being set to 1 kHz, the gain is decreased gently toward 1 kHz from the low frequency side, and is increased relatively rapidly in the portion from 1 kHz to 1.2 kHz.

That is, the details of the gain characteristic to be added to a sound signal can be adjusted. As apparent from the above, filtering in the range of 200 Hz to 1.2 kHz can change the frequency at the bottom or peak of the gain, or can change the gain frequency by frequency.

According to the foregoing embodiment, the band that is associated with the movement of a sound image is set to the band of 200 Hz to 1.2 kHz based on the frequency spectrum set to "upper HRTF−lower HRTF" shown in FIGS. 3A to 3G.

However, this band should not necessarily be restrictive. For example, the frequency band can be shifted slightly according to the distance from the listener to the speaker, the angle defined between the horizontal plane including the ear portion of the listener and the direction of the speaker, or the like.

For example, the lower limit may be set to 200 Hz, and the upper limit may be determined within the range of 1.2 to 2 kHz. When the upper limit is shifted higher, the lower limit may be shifted in the direction of higher frequencies. In any way, it is basically important that the band includes 1.2 kHz.

[Effect of Embodiment]

The sound processing apparatus according to the foregoing embodiment manipulates the spectrum which is related to movement of a sound image in the main sound band different from the directional band (neighborhood of 8 kHz) known in the past. That is, the stable gain structure which appears in the difference between the head-related transfer functions in the upper direction and the lower direction and is related to movement of sound images is reflected on the filtering process to be performed on sound signal.

Accordingly, the sound image moving effect can be realized stably, and the service area can be made wider. That is, both of the stability of the sound image moving effect and the expanding of the service area can be satisfied.

[Method and Program According to Embodiment of the Invention]

It is to be noted that as mentioned above, the sound image localization filter 12 and the 8-kHz band emphasizing filter 15 can be formed by computer such as a digital filer or a DSP.

Accordingly, the method according to the embodiment of the invention is a sound image localization method that causes filter means to provide a sound signal with a characteristic according to a spectrum difference between a previously measured first head-related transfer function of a sound generated from a virtual sound image position to an ear of a listener and a previously measured second head-related transfer function of a sound generated from a real sound source position to the ear, and output the sound signal.

That is, the method according to the embodiment of the invention is adapted to the process that is performed by the sound image localization filter 12 as shown in FIG. 4 or FIG. 8. Further, it is possible to include the function of the 8-kHz band emphasizing filter 15 shown in FIG. 8.

In addition, the program according to the embodiment of the invention is a computer-readable sound image localization program that allows a computer processing sound data to provide a sound signal with a characteristic according to a spectrum difference between a previously measured first head-related transfer function of a sound generated from a virtual sound image position to an ear of a listener and a previously measured second head-related transfer function of a sound generated from a real sound source position to the ear.

That is, the program according to the embodiment of the invention is adapted to the program that is performed by a computer constituting the sound image localization filter 12 as shown in FIG. 4 or FIG. 8. Further, it is possible to include the function of the 8-kHz band emphasizing filter 15 shown in FIG. 8.

As apparent from the above, the sound processing method and the sound processing program which involve what has been described in the foregoing description of the sound processing apparatus according to the embodiment of the invention are the method and program according to the embodiment of the invention.

[Others]

In the foregoing embodiment, sounds input to the sound image localization filter (sound-image shifting up/down filter) 12 can be applied to sound signals which have undergone various kinds of signal processing (or which are present after the sound image localization filter 12) as well as ordinary sounds.

In addition, the invention can be adapted to a television receiver, an on-vehicle audio apparatus, a game device, and various other audio apparatus which reproduce sound signals.

When the invention is adapted to a television receiver and a home game device, particularly, even if a speaker is located below the display screen, for example, the sound image of a sound generated from the speaker can be localized in the direction of the display screen located above the speaker.

Likewise, even if a speaker is located above the display screen, for example, the sound image of a sound generated from the speaker can be localized in the direction of the display screen located below the speaker.

It should be understood by those skilled in the art that various modifications, combinations, sub-combinations and alterations may occur depending on design requirements and other factors insofar as they are within the scope of the appended claims or the equivalents thereof.

What is claimed is:

1. A sound processing apparatus comprising:

a filter means for providing a sound signal with a frequency-gain characteristic according to a spectrum difference between a previously measured first head-related transfer function of a sound generated from a virtual sound image position to an ear of a listener and a previously measured second head-related transfer function of a sound generated from a real sound source position to the ear, and outputting the sound signal; and an emphasis means for emphasizing a neighborhood of a frequency of 8-kHz with respect to an input sound signal when the real sound source position is located under the listener and the virtual sound image position is located above the listener, in which said filter means decreases a gain of a received sound signal in a range of 200 Hz to 1.2 kHz and said emphasis means increases a gain of the input sound signal in the neighborhood of 8 kHz, wherein the gain of the input sound signal in the neighborhood of 8 kHz is increased such that gain increases toward a peak at frequencies lower than 8 kHz and decreases from the peak at frequencies higher than 8 kHz, and such that the maximum rate of gain increase toward the peak at frequencies lower than 8 kHz is greater than the maximum rate of gain decrease from the peak at frequencies higher than 8 kHz.

2. The sound processing apparatus according to claim 1, wherein the filter means provides the sound signal with a frequency-gain characteristic according to the spectrum difference in a frequency zone where a tendency of a change is common in the frequency-gain characteristic indicated by the spectrum difference between the first head-related transfer function and the second head-related transfer function for each azimuth angle, which are to be measured while changing the azimuth angle but without changing a vertical positional relation between the virtual sound image position and the real sound source position with respect to the listener, and outputs the sound signal.

3. The sound processing apparatus according to claim 1, wherein the filter means adjusts a level of the frequency-gain characteristic according to the spectrum difference, and further comprising a level instruction means for accepting information indicating level adjustment of the frequency-gain characteristic according to the spectrum difference from a user, and supplying the information to the filter means.

4. The sound processing apparatus according to claim 2, wherein the filter means adjusts a level of the frequency-gain characteristic according to the spectrum difference, and further comprising a level instruction means for accepting information indicating level adjustment of the frequency-gain characteristic according to the spectrum difference from a user, and supplying the information to the filter means.

5. A sound image localization method comprising:

causing a filter means to provide a sound signal with a frequency-gain characteristic according to a spectrum difference between a previously measured first head-related transfer function of a sound generated from a virtual sound image position to an ear of a listener and a previously measured second head-related transfer function of a sound generated from a real sound source position to the ear; and emphasizing by use of an emphasis means a neighborhood of a frequency of 8-kHz with respect to an input sound signal when the real sound source position is located under the listener and the virtual sound image position is located above the listener, in which said causing includes causing said filter means to decrease a gain of a received sound signal in a range of 200 Hz to 1.2 kHz and said emphasizing includes causing said emphasis means to increase a gain of the input sound signal in the neighborhood of 8 kHz, wherein the gain of the input sound signal in the neighborhood of 8 kHz is increased such that gain increases toward a peak at frequencies lower than 8 kHz and decreases from the peak at frequencies higher than 8 kHz, and such that the maximum rate of gain increase toward the peak at frequencies lower than 8 kHz is greater than the maximum rate of gain decrease from the peak at frequencies higher than 8 kHz.

6. The sound image localization method according to claim 5, wherein the filter means provides the sound signal with a frequency-gain characteristic according to the spectrum difference in a frequency zone where a tendency of a change is common in the frequency-gain characteristic indicated by the spectrum difference between the first head-related transfer function and the second head-related transfer function for each azimuth angle, which are to be measured while changing the azimuth angle but without changing a vertical positional relation between the virtual sound image position and the real sound source position with respect to the listener, and outputs the sound signal.

7. A sound processing apparatus comprising:

a filter unit configured to provide a sound signal with a frequency-gain characteristic according to a spectrum difference between a previously measured first head-related transfer function of a sound generated from a virtual sound image position to an ear of a listener and a previously measured second head-related transfer function of a sound generated from a real sound source position to the ear, and output the sound signal; and an emphasis unit to emphasize a neighborhood of a frequency of 8-kHz with respect to an input sound signal when the real sound source position is located under the listener and the virtual sound image position is located above the listener, in which said filter unit decreases a gain of a received sound signal in a range of 200 Hz to 1.2 kHz and said emphasis unit increases a gain of the input sound signal in the neighborhood of 8 kHz, wherein the gain of the input sound signal in the neighborhood of 8 kHz is increased such that gain increases toward a peak at frequencies lower than 8 kHz and decreases from the peak at frequencies higher than 8 kHz, and such that the maximum rate of gain increase toward the peak at frequencies lower than 8 kHz is greater than the maximum rate of gain decrease from the peak at frequencies higher than 8 kHz.

* * * * *